United States Patent [19]

Oshima et al.

[11] Patent Number: 4,478,910

[45] Date of Patent: Oct. 23, 1984

[54] INK JET RECORDING PAPER

[75] Inventors: Hiroyo Oshima; Yutaka Kojima; Yukio Kobayashi; Takashi Omori; Koichi Nagai, all of Tokyo, Japan

[73] Assignee: Jujo Paper Co., Ltd., Tokyo, Japan

[21] Appl. No.: 592,585

[22] Filed: Mar. 23, 1984

[30] Foreign Application Priority Data

Apr. 7, 1983 [JP] Japan ..... 58-59968

[51] Int. Cl.[3] ..... B41M 5/00

[52] U.S. Cl. ..... 428/331; 346/135.1; 428/206; 428/211; 428/342; 428/452; 428/537.5

[58] Field of Search ..... 346/135.1; 428/206–208, 211, 331, 341, 342, 409, 452, 537

[56] References Cited

U.S. PATENT DOCUMENTS 4,446,174 5/1984 Maekawa et al. ..... 428/211 X

FOREIGN PATENT DOCUMENTS 0051583 4/1980 Japan ..... 428/207

0107878 7/1982 Japan ..... 428/404

*Primary Examiner*—Bruce H. Hess

*Attorney, Agent, or Firm*—Koda and Androlia

[57] ABSTRACT

Ink jet recording paper comprising on a base sheet with a specific sizing degree a coating layer comprising a water-soluble polymeric binder and particular fine silica particles, wherein the sheet provides a superior aptitude for high speed recording with excellent optical density and improved clear image.

5 Claims, No Drawings

INK JET RECORDING PAPER

BACKGROUND OF THE INVENTION

1. Field of the Invention

The present invention relates to a ink jet recording paper of a coated type.

2. Prior Art

The ink jet recording system generates almost no noise, can easily perform a multicolor recording. Owing to these features, this system has found a wide range of application, including facsimile equipments, various printers and so on.

As ink jet recording paper, there can be used the paper of a plain type and that of a coated type.

The recording paper of a plain type and a low sizing degree, although being excellent in the ink absorptivity, has a shortcoming that the clear image can not be obtained because of the ink diffusion into the paper texture and, particularly, it lacks in sufficient resolution power and optical density upon color recording. In view of the above, recent studies have been directed to the development of coated type recording paper of an excellent resolution power. However, since the coated type recording paper adsorbes to retain the dyes in the ink on a coated layer, it results in a drawback of having less aptitude for high speed recording due to the insufficient ink absorptivity, although it has excellent recording density and improved clear image.

By the way, as the information processing speed has been increased rapidly in recent years, a high speed recording is required for the ink jet recording system as in other type of recording systems such as wire-dot recording, electrostatic recording and heat-sensitive recording. On the side of the recording apparatus, a multi-nozzle type high speed printer based on the bubble jet system has already been developed. However, in view of the recording paper for use in the ink jet recording, ink droplets jetted out from a nozzle are deposited on the paper surface and then absorbed into the paper texture to give a dried appearance, wherein the dried state of ink is actually unstable just after the recording. Consequently, the coated type recording paper, although excellent in the resolution power, results in various inherent problems for instance in that the sheets just after the recording are contacted to each other under pressure upon high speed recording and in that the ink is migrated or scratched upon transfer on the roll of the recording apparatus, which are not experienced in other recording systems.

SUMMARY OF THE INVENTION

It is the general object of this invention to provide an ink jet recording paper which has a superior aptitude for high speed recording.

The above object is obtained by using on the base paper with a stöckigt sizing degree of less than 4 sec. (based on a basis-weight of 60 g/m$^2$) a coated layer comprising fine silica particles having a specific surface area of more than 200 m$^2$/g as measured by the BET method and having uniformity number n of the Rosin-Rammler distribution of greater than 1.10.

DETAILED DESCRIPTION OF THE INVENTION

The pigment used in the coating according to this invention comprises fine silica particles having a specific surface area of more than 200 m$^2$/g as measured by the BET method and a uniformity number n of the particle size distribution of greater than 1.10 when expressed by a linear line on the Rosin-Rammler diagram. While the use of silica pigments as the surface coating material for the ink jet recording paper has already been proposed in Japanese Patent Laid-Open No. 51583/1980 or the like, silica materials being capable of actual use for ink jet recording paper are rather restricted among those of various kinds of properties. The fine silica particles selected in this invention provides the sheet having excellent optical density and color, improved clear image and superior aptitude for the high speed recording.

The first condition of the silica for use in this invention is that it has a specific surface area of more than 200 m$^2$/g as measured by the BET method. By applying a coated layer mainly composed of silica with such a large specific surface area, a high optical density and improved clear image can be obtained.

As the second condition, it is required that silica has a uniformity number n of greater than 1.10 in the particle size distribution represented by the linear line on the Rosin-Rammler diagram. A large uniformity number n means a narrow particle size distribution range, and silica with a large specific surface area and a narrow particle size distribution is particularly excellent in the ink absorptivity. By selecting such silica, a coating layer with superior aptitude for high speed recording can be formed. Since a coating layer comprises a dense layered structure composed of a pigment and a binder, it has generally been considered difficult to obtain a coated type recording paper having the ink absorptivity as comparable with that of the ink jet recording paper of plain type and low sizing degree. While it is not clear at present for the reason why the ink absorptivity of the coated layer can be improved significantly in this invention by the selection of the silica having a large specific area and a narrow particle size distribution, it may be considered that agglomeration of silica particles having a uniform particle size distribution will increase voids in the coated layer of appropriate and uniform size suitable to promote the penetration and absorption of the ink, and the effect is particularly remarkable for the silica particles with a large specific surface area.

In relation with the ink absorptivity of the coated layer as described above, a base paper having a Stöckigt sizing degree of less than 4 sec. (based on a basis-weight of 60 g/m$^2$) is used in this invention. The Stöckigt sizing degree of less than 4 sec. (based on a basis-weight of 60 g/m$^2$) means that the value for the Stöckigt sizing degree/basis weight [(sec.)/(g/m$^2$)] is less than 0.07. Since the base paper contains no or little size, the ink component passing through the coated layer easily penetrates and is absorbed into the base paper and, further, the water soluble binder rapidly penetrates into the base paper upon coating, whereby the porosity of the coated layer itself can be increased, to increase the ink penetration and absorptivity of the coated paper. Accordingly, most of commercial woodfree base paper can not be used suitably in this invention because of high sizing degree thereof.

The uniformity number n for the Rosin-Rammler distribution may be determined by the following procedures. Specifically, a silica pigment is dispersed in water and accumulated mass values R (Dp) of particles having a particle diameter Dp are measured within a particle size range from 0.4$\mu$ to 10$\mu$ by using an light transmission type particle size distribution instrument. By plotting them on a Rosin-Rammler diagram (hereinafter referred to as the R-R diagram) based on the Rosin-Rammler's equation: $R(Dp)=100\cdot\exp(-bDp^n)$ [where each of b, n represents constant, n being referred to as the uniformity number or distribution constant], a linear line is obtained. Then, by drawing a linear line passing through a pole point P shown in the R-R diagram in parallel with the plotted linear line and by reading the exponent n on the extension, the uniformity number n can be calculated with ease. The effect of this invention can also be obtained similarly in a case where the measured values for the particle size distribution plotted according to the foregoing method can approximately be regarded as a linear line.

Commercially available silica material capable of satisfying the above two conditions can include, for instance, SILCRON G 100, 600 (manufactured by Nissan Kagaku), SYLOID 404, 79, 74 (manufactured by Fuji Davison Chemical Ltd.), GASIL HP-34 (manufactured by Joseph Crossfield & Sons, Limited), FINESIL X27, X37, 79 (manufactured by Tokuyama Soda Co., Ltd.) and CARPLEX Nr. 80 (manufactured by Shionogi & Co., Ltd.).

A water soluble polymeric binder is suitable as the binder to be combined with the foregoing silica pigment in this invention. Specifically, although polyvinyl alcohol or its derivatives is particularly desired in view of the optical density, those usable binders herein also include oxidized starch, modified starch, gums such as guar gum, sodium alginate, water soluble cellulose derivatives such as hydroxyethylcellulose, methylcellulose and carboxymethylcellulose, water soluble proteins such as soybean protein and casein, as well as water soluble polymeric substance such as polyvinyl pyrrolidone.

Upon preparing a coating material, it is desired to use a relatively large amount of pigment such as using the foregoing silica and the water soluble polymeric binder in a ratio of about 60–95:40–5 in the solid content ratio. If required, clay, talc, calcium carbonate, magnesium carbonate, barium sulfate, titanium white, organic filler or the like may additionally be used as a part of the pigment component.

Upon applying the coating material, an ordinary coating equipments such as a blade, air knife, bar, roll coater or the like or an on-machine sizing press may be used. Since the ink absorptivity is degraded if the amount of coating is excessive, a preferred coating amount on one side is between 3–12 g/m$^2$ based on the silica material.

This invention will now be described referring to examples.

For carrying out the quality test for the recording paper according to this invention, ink jet recording was carried out by using Panafax 6000 manufactured by Matsushita Denso. In the recording black and red two color printing was carried out by using two ink jet guns. At first, the red ink was jetted for 10 sec., then both of red and black inks were jetted for 5 sec. and, finally, only the black ink was jetted for 10 sec. for printing. In the finished printed matter, each of the width printed with the red and black colors individually was 24 mm and the width at the central area printed superimposingly by the black and the red colors was 8 mm. The optical density of the printed matter was measured by a Macbeth Reflectometer using a green filter for magenta and a blue filter for yellow for the red-printed portion and using a visual filter for black-printed portion (all SPI filter), and the optical density was shown by the sum of the optical density values for each color.

The ink absorption time of each recording paper was measured as a time period that the ink droplets of 0.0018 co of cyan ink manufactured by Matsushita Giken are fallen through a microcylinge from the 1 cm height to a paper surface and completely absorbed in the paper structure under the atmosphere of 20° C. and 65% RH.

EXAMPLE 1

15 parts by weight (solid content) of 15% aqueous solution of completely saponified polyvinyl alcohol (PVA 117, manufactured by Kuraray Co., Ltd.) were mixed with each 85 parts by weight (solid content) of silica pigment slurries of silica (SILCRON G 100, manufactured by Nissan Chemical Industries, Ltd.), silica II (FINESIL X27, manufactured by Tokuyama Soda Co., Ltd.) and Silica III (SYLOID 74, manufactured by Fuji Davison Chemical Ltd.) respectively as Examples of this invention, as well as silica IV (CARPLEX FPS-1, manufactured by Shionogi & Co, Ltd.) silica V (CARPLEX FPS-3, manufactured by Shionogi & Co., Ltd.), silica VI (CAPPLEX #1120, manufactured by Shinogi & Co., Ltd.), silica VII Nipsil E200A, manufactured by Nippon Silica Industrial Corporation), silica VIII (Nipsil E220A, manufactured by Nippon Silica Industrial Corporation) and silica XI (Mizukasil P526N, manufactured by Mizusawa Industrial Chemical, Ltd.) as Comparative Examples, to prepare 10 types of coating materials in total. These coating materials were applied to each of woodfree base paper having weight of 63 g/m$^2$ and the Stöckigt sizing degree of 3.6 sec. so as to provide the coating amount of 19–12 g/m$^2$ to obtain recording paper No. 1–No. 9. The results for the ink absorption speed and the recording test of the recording paper were as shown in Table 1.

TABLE 1

| | | Item | | | | | | |
|---|---|---|---|---|---|---|---|---|
| | | Silica Physical property | | Substrate | | Recording paper | | Recorded product |
| No. | Type of Silica | Uniformity number | BET specific surface area (m$^2$/g) | Sizing degree (sec.) | Basis weight (g/m$^2$) | Ink absorption speed (sec.) | Coating amount (g/m$^2$) | Optical density (total value) |
| Example | | | | | | | | |
| 1 | silica I | 1.20 | 293 | 3.6 | 63 | 22.5 | 9–12 | 4.29 |
| 2 | silica II | 1.53 | 270 | " | " | 25.2 | " | 4.67 |
| 3 | silica III | 1.63 | 300 | " | " | 18.0 | " | 4.01 |
| Comparative Example | | | | | | | | |

TABLE 1-continued

| No. | Type of Silica | Item: Silica Physical property: Uniformity number | BET specific surface area ($m^2/g$) | Substrate: Sizing degree (sec.) | Basis weight ($g/m^2$) | Recording paper: Ink absorption speed (sec.) | Coating amount ($g/m^2$) | Recorded product Optical density (total value) |
|---|---|---|---|---|---|---|---|---|
| 4 | silica IV | 0.81 | 240 | " | " | 42.6 | " | 4.23 |
| 5 | silica V | 0.95 | 400 | " | " | 41.1 | " | 3.61 |
| 6 | silica VI | 1.12 | 150 | " | " | 27.4 | " | 2.97 |
| 7 | silica VII | 1.40 | 130 | " | " | 24.8 | " | 3.60 |
| 8 | silica VIII | 1.06 | 130 | " | " | 40.2 | " | 3.67 |
| 9 | silica IX | 1.32 | 143 | " | " | 31.5 | " | 3.48 |
| 10 | with no, coating | — | — | " | " | (71.0) | — | 2.92 |

As can be seen from Table 1, the recording papers No. 1–No. 3 according to this invention have very rapid ink absorption speed of less than 30 sec. and also excellent optical density of the recorded image. On the contrary, the Comparative Examples (recording papers No. 4, No. 5 and No. 8) with the uniformity number n of less than 1.10 show slow ink absorption speed and the Comparative Examples with the BET specific surface area of less than 200 $m^2/g$ (recording papers No. 6, No. 7 and No. 9) show insufficient optical density on the recorded image.

EXAMPLE 2

20 parts by weight (solid content) of 15% aqueous solution of completely saponified polyvinyl alcohol (PVA 117, manufactured by Kuraray Co., Ltd.) were mixed with 80 parts by weight (solid content) of slurry of silica (GASIL HP-34, manufactured by Joseph Crossfield & Sons, Limited) to prepare a coating material, which was applied on each of woodfree base paper of various sizing contents so as to provide a coating amount of 6–8 $g/m^2$ to obtain three types of recording paper.

The results for the recording tests of the recording paper and the plain paper are collectively shown in Table 2.

TABLE 2

| No. | Paper with no coating | Presence or absence coating | Item: Silica Physical property: Uniformity number | BET specific surface area ($m^2/g$) | Base paper: Sizing degree (sec.) | Basis-weight ($g/m^2$) | Recording paper: Ink absorption speed (sec.) | Coating amount ($g/m^2$) | Recorded product Optical density (total value) |
|---|---|---|---|---|---|---|---|---|---|
| Example | | | | | | | | | |
| 11 | A | Presence | 1.63 | 280 | 0 | 60 | 9.2 | 6–8 | 4.32 |
| 12 | B | " | " | " | 3.6 | 63 | 26.5 | " | 4.36 |
| Comparative Example | | | | | | | | | |
| 13 | C | " | " | " | 5.2 | 69 | 880.0 | " | 4.59 |
| 14 | A | Absence | — | — | 0 | 60 | 7.1 | — | 2.90 |
| 10 | B | " | — | — | 3.6 | 63 | 71.0 | — | 2.92 |
| 15 | C | " | — | — | 5.2 | 69 | 1,590.0 | — | 3.56 |

As can be seen from Table 2, the recording papers coated with the silica material selected according to this invention (No. 11, No. 12, No. 13) are extremely satisfactory with respect to the optical density on the recorded products irrespective of the types of the base paper.

However, it is shown that the ink absorption speed is greatly dependent on the sizing degree of the base paper and, if the sizing degree exceeds 4 sec. (based on a basis-weight of 60 $g/m^2$), even the coated layer of the selected silica can no more be function well.

We claim:

1. Ink jet recording paper comprising on a base sheet a coating layer, said base sheet having a Stöckigt sizing degree of less than 4 sec. (based on a basis-weight of 60 $g/m^2$), and said coating layer comprising a water-soluble polymeric binder and fine silica particles having a specific surface area of more than 200 $m^2/g$ as measured by the BET method and a uniformity number n of the Rosin-Rammler distribution of greater than 1.10.

2. Ink jet recording paper according to claim 1, in which said silica and said soluble polymeric binder ranges in a ratio of about 60–95:40–5.

3. Ink jet recording paper according to claim 1 or 2, in which said water-soluble polymeric binder is at least one substance selected from the group consisting of modified starch, gum, sodium alginate, water soluble cellulose derivative and water soluble protein.

4. Ink jet recording paper according to claim 1 or 2, in which said water-soluble polymeric binder is at least one substance selected from the group consisting of polyvinyl alcohol and derivative thereof.

5. Ink jet recording paper according to claim 1 or 2, in which the coating amount on one side of said base sheet ranges in an amount of 3–12 $g/m^2$ based on the silica material.

* * * * *